US006855093B2

(12) United States Patent
Anderson et al.

(10) Patent No.: US 6,855,093 B2
(45) Date of Patent: Feb. 15, 2005

(54) STAIRCLIMBER APPARATUS PEDAL MECHANISM

(75) Inventors: Timothy T. Anderson, Antioch, IL (US); Byron T. DeKnock, Des Plaines, IL (US); Mark C. Termion, Winfield, IL (US)

(73) Assignee: Brunswick Corporation, Lake Forest, IL (US)

( * ) Notice: Subject to any disclaimer, the term of this patent is extended or adjusted under 35 U.S.C. 154(b) by 562 days.

(21) Appl. No.: 09/903,967

(22) Filed: Jul. 12, 2001

(65) Prior Publication Data

US 2003/0013582 A1 Jan. 16, 2003

(51) Int. Cl.[7] ..... A63B 23/64; A63B 22/04
(52) U.S. Cl. ..... 482/52; 482/51
(58) Field of Search ..... 482/51–53, 57, 482/70, 79, 80, 37, 112

(56) References Cited

U.S. PATENT DOCUMENTS

| | | | | |
|---|---|---|---|---|
| 4,687,195 | A | 8/1987 | Potts | 272/69 |
| 4,708,338 | A | 11/1987 | Potts | 272/70 |
| 4,850,585 | A | 7/1989 | Dalebout | 272/70 |
| 4,949,993 | A | 8/1990 | Stark et al. | 272/70 |
| 5,135,447 | A | 8/1992 | Robards, Jr. et al. | 482/52 |
| 5,180,351 | A | 1/1993 | Ehrenfried | 482/52 |
| 5,183,448 | A | 2/1993 | Wang | 482/52 |
| 5,192,257 | A | 3/1993 | Panaswicz | 482/70 |
| 5,195,935 | A | 3/1993 | Fencel | 482/70 |
| 5,230,673 | A | 7/1993 | Maeyama et al. | 482/5 |
| 5,238,462 | A | 8/1993 | Cinke et al. | 482/52 |
| 5,256,117 | A | 10/1993 | Potts et al. | 482/52 |
| 5,263,909 | A | 11/1993 | Ehrenfried | 482/52 |
| 5,336,142 | A | 8/1994 | Dalebout et al. | 482/52 |
| 5,336,143 | A | 8/1994 | Wu | 482/52 |
| 5,403,252 | A | 4/1995 | Leon et al. | 482/52 |
| 5,490,818 | A | 2/1996 | Haber et al. | 482/52 |
| 5,518,473 | A | 5/1996 | Miller | 482/57 |
| 5,540,637 | A | 7/1996 | Rodgers, Jr. | 482/52 |
| 5,549,526 | A | 8/1996 | Rodgers, Jr. | 482/57 |
| 5,573,480 | A | 11/1996 | Rodgers, Jr. | 482/57 |
| 5,577,985 | A | 11/1996 | Miller | 482/52 |
| 5,593,372 | A | 1/1997 | Rodgers, Jr. | 482/52 |
| 5,741,205 | A | 4/1998 | Doll et al. | 482/52 |
| 5,857,941 | A | 1/1999 | Maresh et al. | 482/52 |
| 6,186,929 | B1 | 2/2001 | Endelman et al. | 482/121 |

FOREIGN PATENT DOCUMENTS

| | | |
|---|---|---|
| WO | WO9402214 | 2/1994 |
| WO | WO9409857 | 5/1994 |

*Primary Examiner*—Stephen R. Crow
(74) *Attorney, Agent, or Firm*—Michael B. McMurry

(57) ABSTRACT

A simulated stair climbing-type exercise apparatus is provided having a frame, a resistance member, a transmission, a drive belt, a right pedal assembly, a left pedal assembly and a track mounted to the frame to provide a user with a vertically reciprocating exercise movement. The right pedal assembly, operating independently of the left pedal assembly and having a set of rollers engaged with the track, oscillates between an upper position at rest and a lower position under the weight of the user. The left pedal assembly, operating independently of the right pedal assembly and having a set of rollers engaged with the track, oscillates between an upper position at rest and a lower position under the weight of the user. The pedal assemblies remain parallel to a support surface throughout their entire range of motion, as the pedal assemblies travel from their upper position to their lower position.

13 Claims, 5 Drawing Sheets

STAIRCLIMBER APPARATUS PEDAL MECHANISM

FIELD OF THE INVENTION

The present invention relates to exercise equipment and more particularly to exercise equipment which simulates aerobic stair climbing.

BACKGROUND OF THE INVENTION

Stair climbing is recognized as a particularly effective type of aerobic exercise, and as a result, exercise machines facilitating this type of exercise are popular for both home and health club use.

There have been a variety of approaches taken in designing stair climbing apparatus, including the simulation of an actual staircase as illustrated in U.S. Pat. Nos. 3,497,215, 3,747,924, 4,687,195, 5,183,448, 5,263,909 5,299,993 and 5,336,143. Another approach has been to simulate the action of stair climbing by using a pair of reciprocating pedals.

As exemplified by U.S. Pat. No. 5,135,447, reciprocating pedal machines include a pair of pedals which are adapted for vertical reciprocating motion to provide a user who is standing on the pedals with a simulated climbing exercise. The vertical reciprocating motion is typically translated into a rotary motion by a suitable system of belts, gears and clutches, for example. The rotary motion (which can be imparted to a shaft, flywheel or the like) is opposed by a variable source of resistance force, typically an alternator, eddy current brake or the like. The load device is responsive to a control signal for selectively varying the level of resistance.

Other previous attempts at simulating stair climbing exercisers, such as Potts, U.S. Pat. No. Re. 34,959, feature independently oscillating pedals wherein the speed may be controlled and monitored by the operator, or may be preselected, controlled and monitored by computer control programs. Some such apparatuses produce an unnatural heel to toe flexure that reduces exercise efficiency. As will be appreciated, in the present invention, the foot pedal assembly remains parallel to a support surface throughout its entire range of motion, as the foot pedal assembly travels from its upper position to its lower position, thereby producing a more natural heel to toe flexure which increases exercise efficiency, making it easier and more enjoyable to exercise.

Additionally, the Potts disclosure simulates stair climbing through the utilization of a four-bar linkage pedal system and a frame plate. One disadvantage of this mechanism is that the angle in which the drive belts are connected to the pivot arms supporting the pedals varies as the pedals move up and down. This results in variations in tension in the belt, torque loads and ultimately variations on the resistance applied to the pedals. Also, such four-bar linkage pedal systems with frame plates tend to be noisy, have numerous pinch points, and substantially increase manufacturing and repair expense. Moreover, due to the large number of pivot points in this type of linkage, the linkages frequently become loose and require frequent maintenance. As a result, it is desirable to decrease the manufacturing expense, improve the smoothness of pedal motion, reduce maintenance costs and decrease noise of stair climbing apparatuses.

Another previous stair climbing exercise apparatus Is disclosed in Doll et al, U.S. Pat. No. 5,741,205. In this apparatus, cables or belts are substituted for the four bar linkage of Potts which eliminates some of the mechanical problems of this arrangement. However, the varying angle of connection of the belt to the pedal support member remains.

In general, the objective of these systems is to simulate stair climbing. Stair climbing is characterized by its uniform, repetitive nature. Ideally, stair climbing apparatuses would provide a more dynamic climbing simulation to increase user interest. A need therefore exists for an improved stair climbing apparatus.

SUMMARY OF THE INVENTION

It is, therefore, a principal object and purpose of the present invention to provide an exercise apparatus that accurately and dynamically simulates stair climbing and is of a light weight and simple design.

It is an additional principal object and purpose of the present invention to provide a stair climbing exercise apparatus that maintains its pedal assembly in a level position, parallel to a support surface, throughout its entire range of motion, as the pedal assembly travels from its upper position to its lower position.

It is another object and purpose of the present invention to provide a stair climbing exercise apparatus that simulates a natural stair climbing exercise and thereby promotes exercise efficiency.

It is still another object and purpose of the present invention to provide a stair climbing exercise apparatus wherein the two pedals operate independently of each other. Each pedal is connected to the transmission by a separate belt drive.

It is an additional object and purpose of the present invention to provide a stair climbing exercise apparatus that is less stressful on the user's body ligaments than running, aerobic dancing or other aerobic exercises since it eliminates jarring of the body.

These and other objectives and advantages are provided by the present invention which is directed to a stair climbing exercise apparatus that maintains the user's feet parallel to the floor throughout the apparatus' entire range of motion. It should be noted, however, that the exercise apparatus can also maintain the user's feet at an angle to the support surface if that proves desirable. The stair climbing exercise apparatus includes a frame that is adapted for placement on the floor, a resistance member which provides a resistive force to pedal assemblies, a transmission including a pair of one way clutches, a drive belt supported by the frame, independently operating right and left pedal assemblies including pedals, and a track. The track is secured to the frame and engages the right and left pedal assemblies such that the pedal assemblies move in a linear reciprocating path throughout their entire range of motion, as the pedal assemblies travel from their upper position to their lower position. Consequently, as the pedal assemblies move in their linear reciprocating path, the pedals remain parallel to a relatively fixed plane, such as the floor.

A second embodiment of the invention includes a frame, a resistance member which provides a resistive force to pedal assemblies, a transmission, a drive belt supported by the frame, independently operating right and left pedal assemblies including pedals, and an arcuate track. The track is secured to the frame and engages the right and left pedal assemblies such that the pedal assemblies move in an arcuate reciprocating path throughout their entire range of motion, as the pedal assemblies travel from their upper position to their lower position. Consequently, as the pedal assemblies move in their arcuate reciprocating path, the pedals remain parallel to a relatively fixed plane, such as the floor.

Both of the above embodiments of the invention can also include a data input means and a control means. The data input means permits the user to input control signals. The control means responds to the input control means to control the resistance member and apply a braking force to the pedal assemblies. The user can thus control the amount of resistance offered by the pedal assemblies and so can vary the degree of effort required to move the pedals. The invention thus can accommodate the individual needs and desires of different users.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

Figure 1:
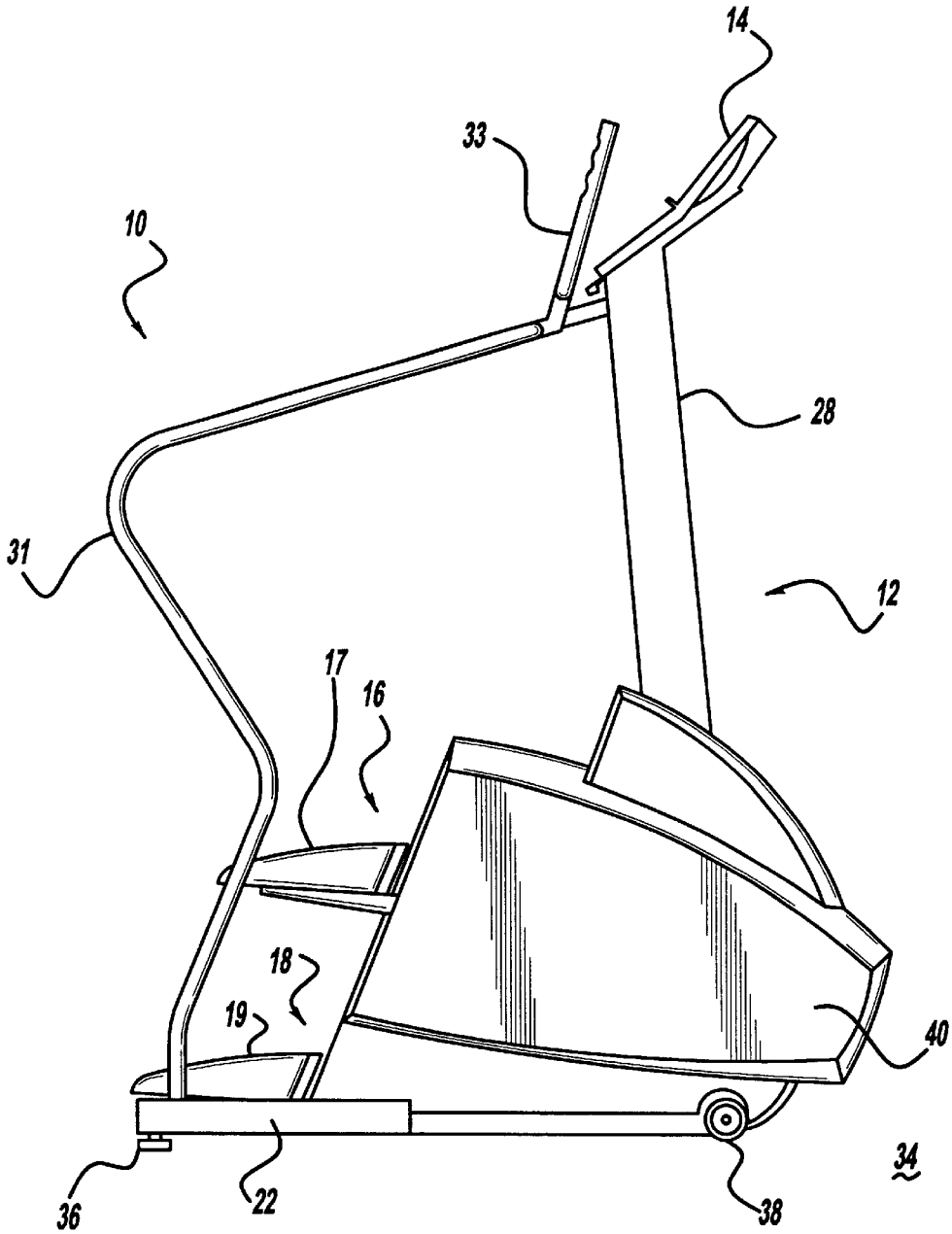
FIG. 1 is a side view of a stair climbing exercise apparatus in accordance with the invention.
Figure 2:
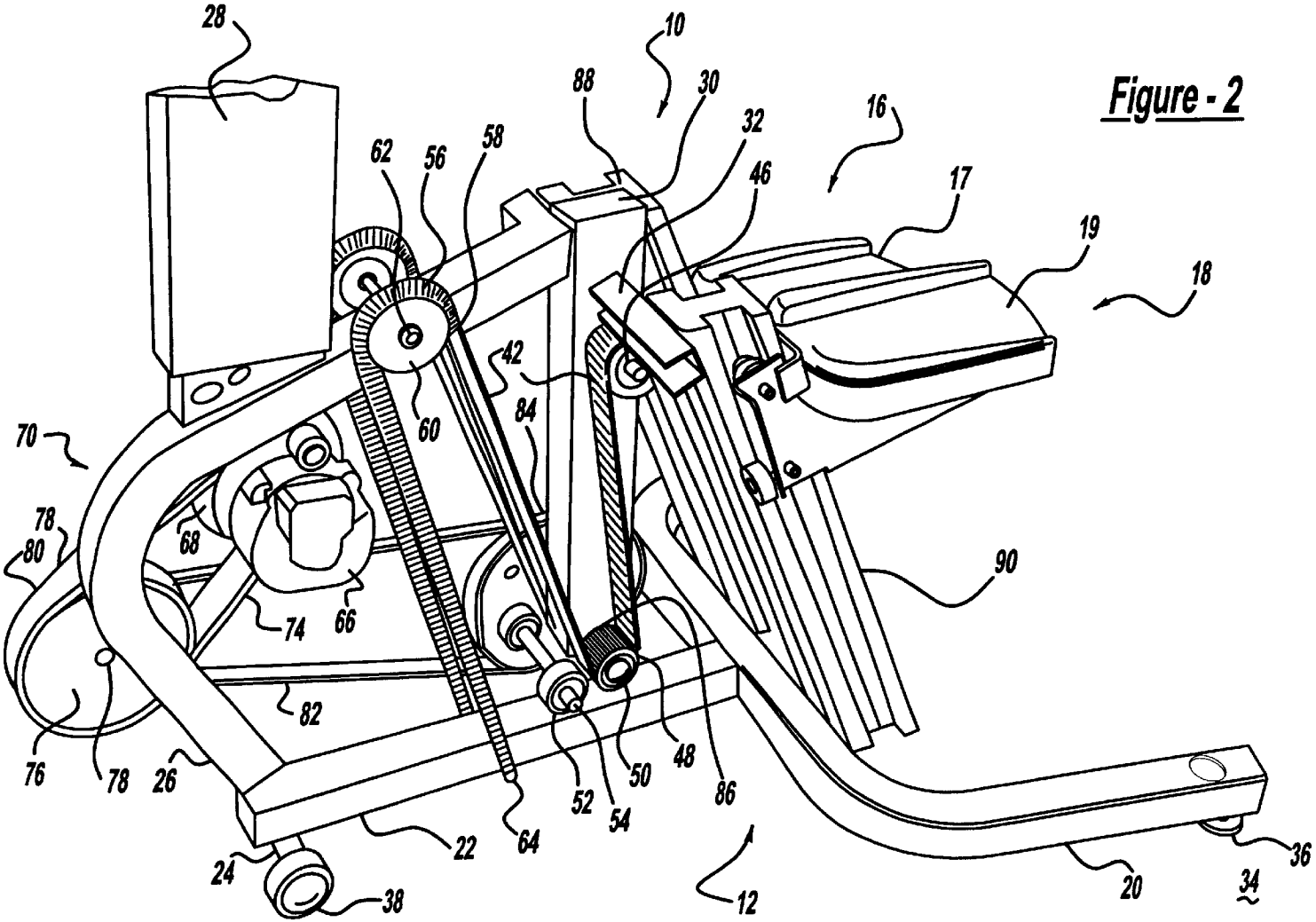
FIG. 2 is a partially cut-away left perspective side view of a pedal assembly for use with the stair climbing exercise apparatus in FIG. 1.

Referring to the drawings in detail, FIGS. 1 and 2 depict the preferred embodiment of a stair climbing-type exercise apparatus 10 that includes a tubular frame 12, a control panel 14, a right pedal assembly 16 including a pedal 17 and a left pedal assembly 18 including a pedal 19. The frame 12 acts as the supporting structure for the stair climbing-type exercise apparatus 10 and can be of any suitable construction. It should also be understood that a number of different frame structures can be used to support the elements of the apparatus 10 such as the frames shown in the existing stair climbers described above. In the illustrated preferred embodiment, the frame 12 includes a generally U-shaped support member 20, a longitudinal support member 22 secured to the U-shaped support member 20, a cross member 24 secured to the longitudinal support member 22, a generally curved support member 26 secured to the longitudinal support member 22, a first vertical support member 28 secured to the curved support member 26, a second vertical support member 30 secured to the curved support member 26 and the longitudinal support member 22, and a cross member 32 secured to the second vertical support member 30. The first vertical support member 28 provides support for the control panel 14. Additionally, handrails 31, including handgrips 33, are rigidly secured to the U-shaped support member 20.

The U-shaped support member 20, the longitudinal support member 22 and the cross member 24 are configured for placement on a floor 34. Levelers 36 are provided on the U-shaped support member 20 so that if the floor 34 is uneven, the U-shaped support member 20 can be raised or lowered such that the U-shaped support member 20, the longitudinal support member 22 and the cross member 24 are substantially level. Rollers 38 are provided on the cross member 24 so that the stair climbing-type exercise apparatus 10 can be easily moved from one location to another.

The stair climbing-type exercise apparatus 10 includes a right cover 40 and a left cover (not shown) to protect and shield from view the internal components of the stair climbing-type exercise apparatus 10. The central location of the internal components, between the legs of the user, provides stability to the stair climbing-type exercise apparatus 10 and allows for a lightweight and simple design.

Figure 4:
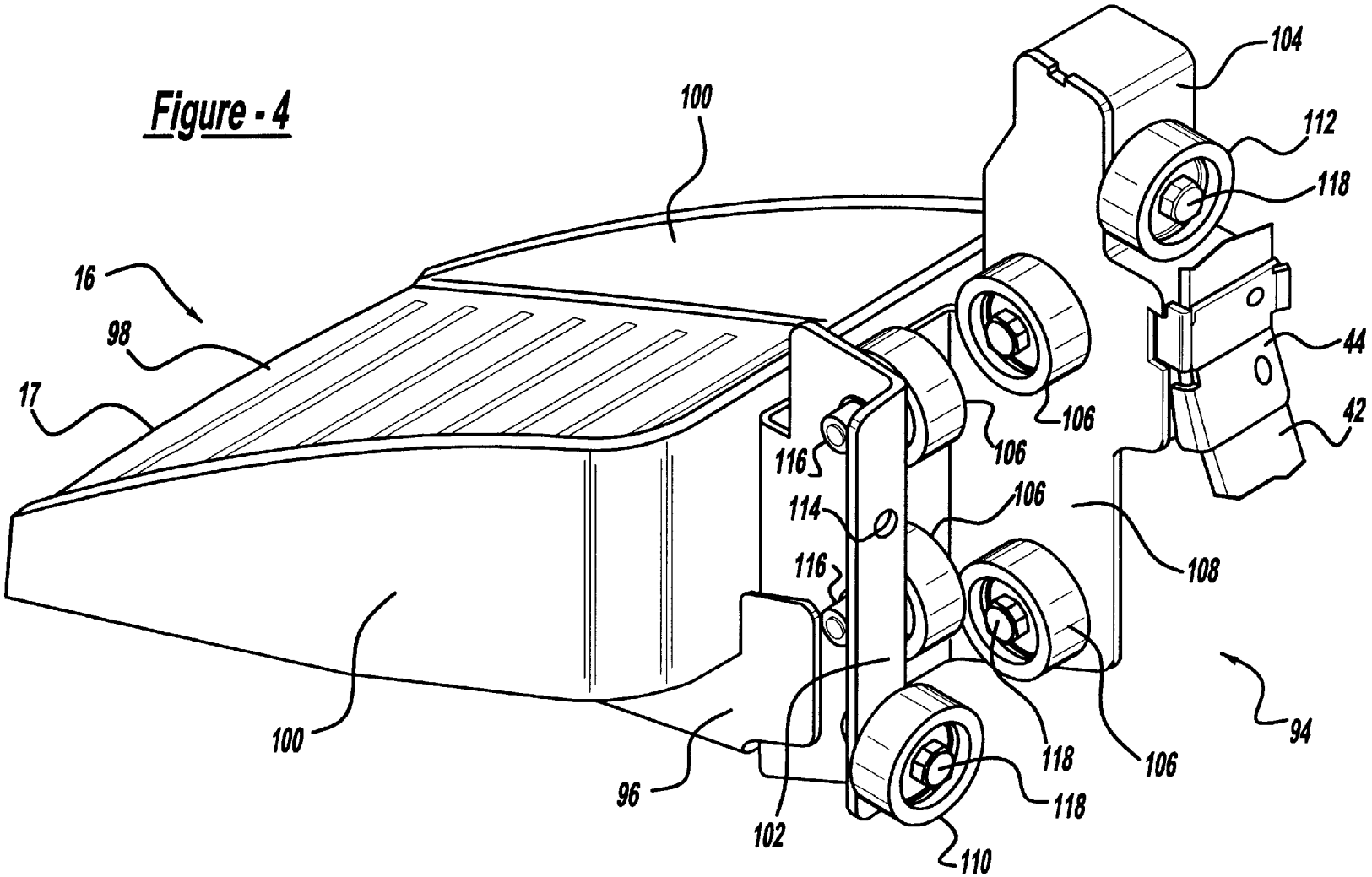
FIG. 4 is a side perspective view of the right pedal assembly for the stair climbing exercise apparatus in FIG. 2.

As described above, the pedal assemblies 16 and 18 oscillate independently of each other. As a result, when the right pedal 17 moves, it is not necessary that the left pedal 19 be also in motion. The operation of the right pedal assembly 16 is similar to the operation of the left pedal assembly 18. Thus, the operation of only the left pedal assembly 18 will be described. The left pedal assembly 18 is connected to a drive belt 42. The drive belt 42 can be connected to the left pedal assembly 18 in any way suitable to fixedly secure the drive belt 42 to the left pedal assembly 18. For example, the drive belt 42 can be connected to the left pedal assembly 18 by a winglet or a leaf spring. As shown in FIG. 4, the drive belt 42 can be secured to the left pedal assembly 18 by a U-shaped belt clamp 44 and bolt (not shown) which permits rapid and convenient release of the drive belt 42 although preferably the clamp 44 can be replaced by a semicircular portion of a grooved pulley. Since this attachment method results in the attachment of the drive belt 42 being essentially in the same plane as the pedal assembly 18, tensile forces on the drive belt 42 are essentially constant as the pedal assembly 18 moves up and down. Therefore, the force on the drive belt 42 and the torque applied from a resistance mechanism attached to the drive belt 42 will remain substantially more constant than in the previous stair climber apparatus discussed above.

As illustrated in FIG. 2, once connected to the left pedal assembly 18, the drive belt 42 first engages a smooth idler pulley 46 rotatably mounted to the second vertical support member 30 by any suitable mounting means such as a shaft. Preferably, the outer surface of the pulley 46 is crowned in order to maintain the belt 42 centered on the pulley 46. Thereafter, the drive belt 42 continues down and engages a grooved clutch pulley 48. The grooved clutch pulley 48 is rotatably mounted to the second vertical support member 30 through a shaft 50. A second smooth idler pulley 52 operates to maintain the drive belt 42 in engagement with the grooved clutch pulley 48. The second smooth idler pulley 52 is located in close proximity to the grooved clutch pulley 48 and is rotatably mounted to a shaft 54 by any suitable mounting means. The shaft 54 is in turn secured to the second vertical support member 30. With continued reference to FIG. 2, the drive belt 42 is also connected to a return spring 56 by a connector 58. The connector 58 can be any suitable connector known in the art. In the preferred embodiment, the connector 58 is a bolt and clamp arrangement. The return spring 56 travels over a guide sheave or pulley wheel 60 rotatably mounted to a shaft 62 by any suitable mounting means. The shaft 62 is in turn secured to the curved support member 26 in close proximity to the first vertical support member 28. Thereafter, the end of the return spring 56 is secured to the longitudinal support member 22 by any suitable securing means known in the art. In the preferred embodiment, the end of the spring 56 is hooked over a post 64 mounted to the longitudinal support member 22. The spring 56 has sufficient tension to return the left pedal assembly 18 to an upper position as illustrated in FIG. 2. When the user steps on the left pedal 19, the return spring 56 will extend so as to allow the end of the drive belt 42 attached to the spring 56 to move downward towards the floor 34. When the user's foot is lifted, the spring 56 will cause the left pedal assembly 18 to return to the upper position as illustrated in FIG. 2. The weight of the user, thus activates the pedal assemblies 16 and 18. Again, the operation of the right pedal assembly 16 is similar to the operation of the left pedal assembly 18.

In order to regulate the rate at which the right pedal assembly 16 and the left pedal assembly 18 can be moved and thus control the rate of simulated stair climbing, a variable source of resistance force is provided. Preferably, the variable source of resistance force is an alternator 66 and its associated combined flywheel and pulley 68 secured to the curved support member 26 as illustrated in FIG. 2. Rotational resistance is applied from the alternator 66 to the combined flywheel and pulley 68 and then to the drive belt 42 by a double reduction transmission 70. The double reduction transmission 70 includes the combined flywheel and pulley 68, a belt 74 connected to the combined flywheel and pulley 68 and a pulley 76 rotatably coupled to a stationary shaft 78, a second pulley 80 coupled to the pulley 76 which is mounted on the shaft 78, and a drive belt 82 connecting the second pulley 80 to a third pulley 84 which is in turn coupled to the shaft 50. The belt 74 and the drive belt 82 can be any type of belt which promotes quiet operation of the stair climbing-type exercise apparatus 10, or drive chains, or any other type of flexible power transmitting device.

In addition, a pair of one way clutches 86, which are commonly known in the art and discussed in the previously described stair climbers, are utilized to connect each grooved clutch pulley 48 to the shaft 50. The function of the one way clutches 86 is to ensure that torque is only transmitted in one direction to the the shaft 50 and hence the alternator 66 can only rotate in one direction even though each grooved clutch pulley 48 will be rotating in both directions due to the reciprocating motion of the right pedal assembly 16 and the left pedal assembly 18.

Figure 3:
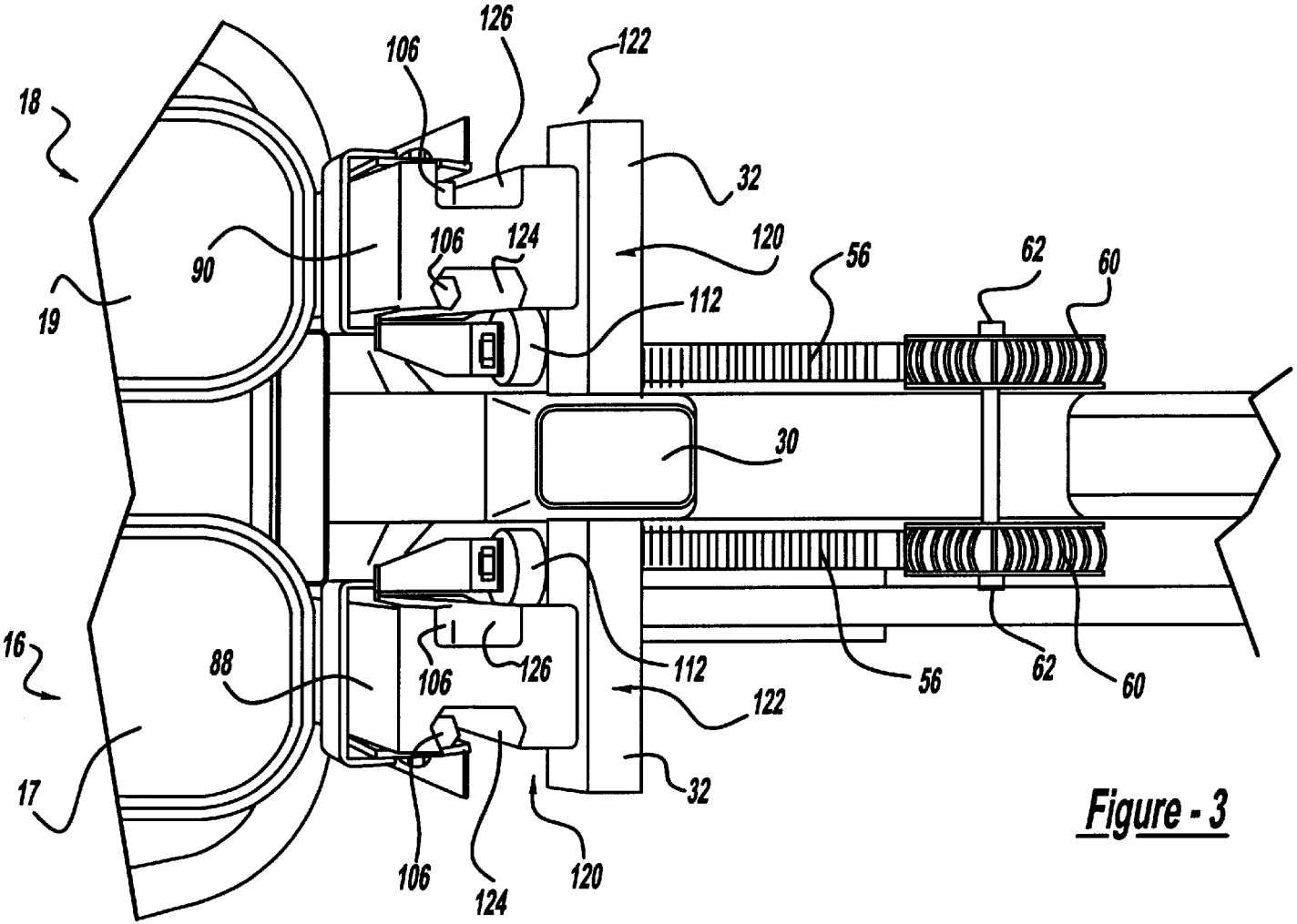
FIG. 3 is a top view of the preferred embodiment of the pedal assembly and linear track member of the stair climbing exercise apparatus in FIG. 2.

As illustrated in FIGS. 2 and 3, the stair climbing-type exercise apparatus 10 further includes a right linear track member 88 and a left linear track member 90. The right linear track member 88 and the left linear track member 90 are secured to the U-shaped support member 20 at a bottom portion thereof and the cross member 32 at a top portion thereof by any suitable securing means.

With reference to FIG. 4, the right pedal assembly 16 and the left pedal assembly 18 will be described in further detail. As with the operation, the description of the right pedal assembly 16 is similar to the description of the left pedal assembly 18. Thus, the description of only the right pedal assembly 16 will be discussed. The right pedal assembly 16 includes the pedal 17, a track engaging bracket 94 and a support bracket 96 which supports and connects the pedal 17 to the track engaging bracket 94.

The pedal 17 includes a pad portion 98 which forms the tread portion of the right pedal assembly 16 and a U-shaped foot retaining wall 100 which aids in keeping the user's foot within the pad portion 98. The track engaging bracket 94 is generally U-shaped, and includes a flange portion 102 and a drive belt retaining portion 104. The drive belt retaining portion 104 is generally taller than the flange portion 102 and is located in close proximity to the second vertical support member 30. A set of longitudinal rollers 106 are rotatably mounted to an inner surface 108 of the track engaging bracket 94. A set of lateral rollers including a roller 110 mounted to the flange portion 102, and a roller 112, rotatably mounted to the drive belt retaining portion 104, is used to retain the right pedal assembly 16 in the track 90 and permit the assembly 16 to move in a generally vertical direction along the track 90. Rollers 106, 110 and 112 are mounted by any suitable mounting means. In the preferred embodiment, as shown in FIG. 4, the rollers 106, 110 and 112 are mounted to the track engaging bracket 94 through apertures 114 by use of a nut 116 and a bolt 118 arrangement. For clarity purposes, a roller located above In the preferred embodiment, shown in FIG. 4, the rollers 106 and the roller 110 are arranged so as to provide the maximum amount of contact with the right linear track member 88 along with maximum support in the longitudinal and lateral directions. Other arrangements of rollers can be used depending upon, for example, the configurations of the tracks 88 and 90. It should also be noted that there are a number of ways in which the previously described drive belt retaining portion 104 can be configured including substituting a sectioned part of a grooved pulley, such as pulley 48, for the U-shaped belt clamp 44 to secure the drive belt 42 to the right pedal assembly 16.

As illustrated in FIG. 3, the right linear track member 88 and the left linear track member 90 are each configured with a right track portion 120 and a left track portion 122. The right track portion 120 includes a track 124 and the left track portion 122 includes a track 126. Although the tracks 124 and 126 can have a variety of cross sectional configurations, the track 124 is shown as having a hexagonal shape, the preferred shape for both tracks 124 and 126 is rectangular as indicated by the track 126 in FIG. 3. With continued reference to FIGS. 2 and 3, during operation, rollers 106 ride within hexagonally shaped track 124 and rectangularly shaped track 126. For the right pedal assembly 16, roller 112 rides primarily on the left track portion 122 while roller 110 rides primarily on the right track portion 120. In this regard, the left pedal assembly 18 is a mirror image of the right pedal assembly 16. Thus, for the left pedal assembly 18, roller 112 rides primarily on the right track portion 120 while roller 110 rides primarily on the left track portion 122.

In order to operate the stair climbing-type exercise apparatus 10, the user will grasp the the hand rails 31 or the handgrips 33 and step up onto both the right pedal 17 and the left pedal 19. Under the weight of the user, the pedal assemblies 16 and 18 will move downward to their lowermost position near the floor 34. The user will then press the start/enter key on the control panel 14, which will prompt the user to enter the required information and to select among the various programs. First, the user is prompted to enter the user's weight. The control panel 14 then lists the various exercise programs and prompts the user to select a program. Once a program is chosen, the control panel 14 prompts the user to provide program-specific information. After the user has entered all the program-specific information, the user is prompted to specify the goal type (time or calories), to specify the desired exercise duration in either total time or total calories, and to chose between one of the numerous exercise levels. Once the user has entered all the required parameters, a microprocessor implements the chosen exercise program based on the information provided by the user. The user will then begin the simulated stair climbing exercise, adjusting his or her step length to a comfortable one. When the user then operates the right pedal assembly 16 and the left pedal assembly 18 in the previously described manner, the right pedal assembly 16 moves along the right linear track member 88 while the left pedal assembly 18 moves along and the left linear track member 90, in a linear path that simulates a natural heel to toe flexure that minimizes or eliminates stresses due to unnatural foot flexures since the pedal assemblies remain parallel to a relatively fixed plane, such as the floor 34 throughout their entire range of motion, as the pedal assemblies 16 and 18 travel from their upper position to their lower position. It should be noted, however, that the right pedal 17 and the left pedal 19 can be set at an angle to the floor 34 if such a position should prove desirable. The stair climbing-type exercise apparatus 10 thus provides a wide variety of exercise programs that can be tailored to the specific needs and desires of individual users, and consequently, enhances exercise efficiency and promotes a pleasurable exercise experience.

Figure 5:
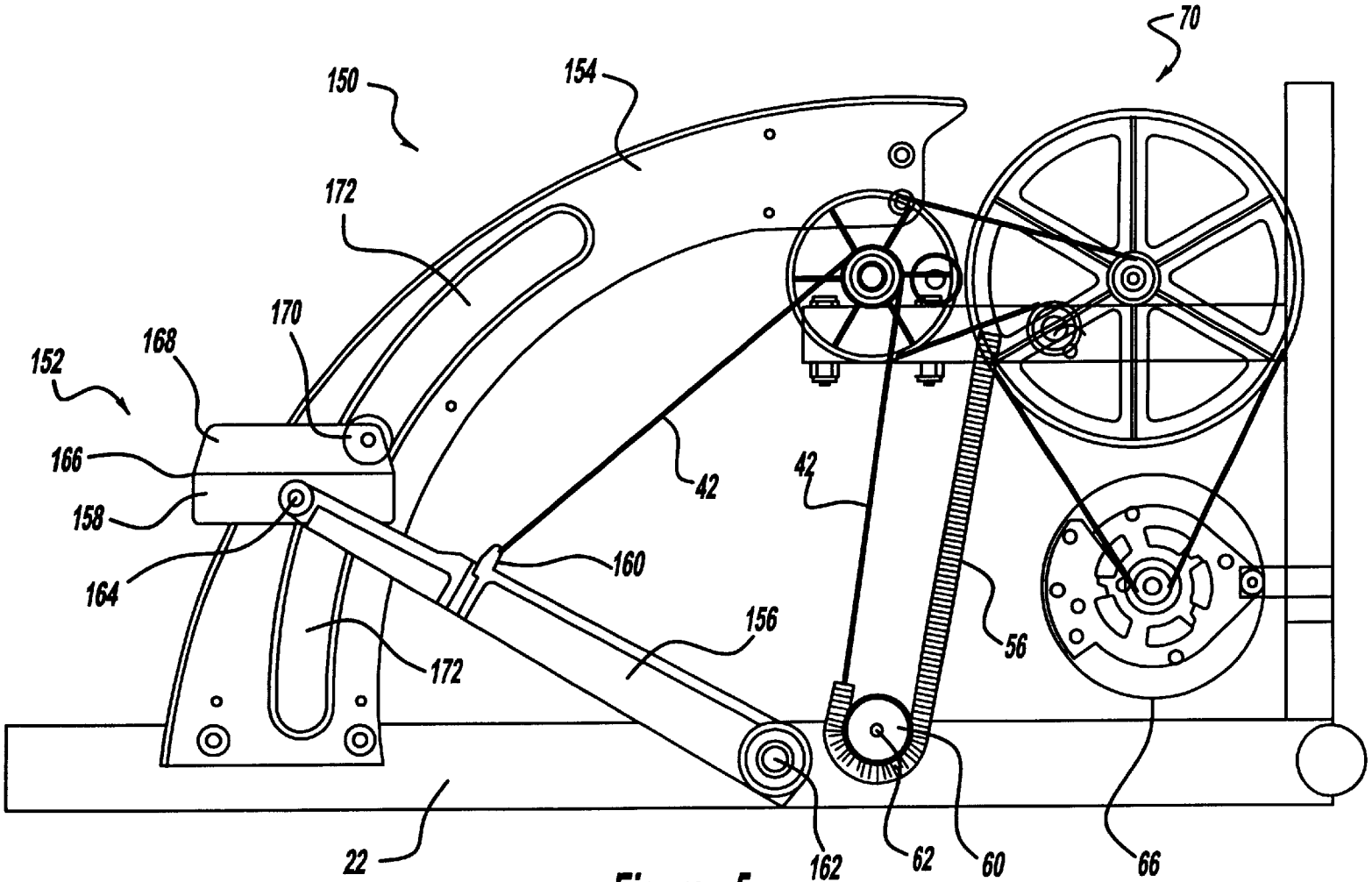
FIG. 5 is a side view of a second embodiment of a pedal assembly and arcuate track member of a stair climbing exercise apparatus in accordance with the invention.

FIG. 5 illustrates a second general embodiment 150 of a stair climbing-type exercise apparatus according to the invention. As noted previously, the second embodiment 150 of the invention includes a second type of pedal assembly and a second type of track, but still exhibits the desired parallel relationship between the pedal assemblies and a relatively fixed plane, such as a floor. As with the previous embodiment 10, the stair climbing-type exercise apparatus 150 includes, but is not limited to, the frame 12, the control panel 14, the drive belt 42, and the various motion controlling components, such as the alternator 66, the double reduction transmission 70, the combined flywheel and pulley 68, the belt 74, the drive belt 82 and the one way clutches 86. The stair climbing-type exercise apparatus 150 differs primarily from the previous embodiment 10 in the nature and construction of the pedal assemblies and the track.

The stair climbing-type exercise apparatus 150 includes a right pedal assembly 152, a left pedal assembly (not shown) and an arcuate track member 154. As with the previous embodiment 10, the operation and description of the right pedal assembly 152 is similar to the operation and description of the left pedal assembly (not shown). Thus, the operation and description of only the right pedal assembly 152 will be discussed.

The right pedal assembly 152 of the stair climbing-type exercise apparatus 150 includes a lever arm 156 and a pedal 158. The drive belt 42 is connected to the lever arm 156 by a connector 160. The connector 160 can be any suitable connector as previously discussed or known in the art. The lever arm 156 is pivotably coupled to the longitudinal support member 22 at a pivot point 162. Likewise, the pedal 158 is pivotably coupled to the lever arm 156 at a pivot point 164. The pedal 158 includes a foot pad portion 166 which forms the tread portion of the pedal 158 and side walls 168. A roller 170 is rotatably mounted to an inner surface of the side walls 168 by any suitable mounting means.

With continued reference to FIG. 5, the arcuate track member 154 is centrally located between the right pedal assembly 152 and the left pedal assembly (not shown). The arcuate track member 154 is secured to the longitudinal support member 22 and to the first vertical support member 28 by any suitable securing means. The arcuate track member 154 also includes a centrally located slot 172 formed therein. As such, the roller 170, mounted to the pedal 158, rides within the slot 172 formed in the arcuate track member 154 during the pedal's entire range of motion, from its upper position to its lower position.

In this embodiment, the stair climbing-type exercise apparatus 150 can use the same programs as the previously describes apparatus 10. When the user then operates the stair climbing-type exercise apparatus 150 as described above, the pedal assemblies move along the arcuate track member 154 in an arcuate path that simulates a natural heel to toe flexure that minimizes or eliminates stresses due to unnatural foot flexures since the pedal assemblies remain parallel to a relatively fixed plane, such as the floor 34 throughout their entire range of motion, as the pedal assemblies travel from their upper position to their lower position.

Although the present invention has been described with reference to specific embodiments thereof, it will be understood that various changes and modifications will be suggested to one skilled in the art and it is intended that the invention encompass such changes and modifications as fall within the scope of the appended claims.

We claim:

1. A simulated stair climbing-type exercise apparatus comprising:

a stationary frame adapted for placement on a horizontal surface;

a first pedal assembly having a first pedal at least one roller and a second pedal assembly having a second pedal and at least one roller, movable with respect to said frame in a generally vertical direction;

a resistance force mechanism secured to said frame;

a transmission including a pair of one way clutches for directly connecting said first pedal assembly and said second pedal assembly to said resistance force means such that said resistance force mechanism is effective to apply a resistance force opposing said first pedal assembly and said second pedal assembly movement in a downward direction;

a first flexible member connecting said first pedal assembly to said one of said pair of one way clutches and a second flexible member connecting said second pedal assembly to said other of said pair of one way clutches; and a first and a second track member secured to said frame, said roller of said first pedal assembly operably engaged with said first track member and roller of said second pedal assembly operably engaged with said second track members such that said first pedal and said second pedal are maintained generally parallel to a predetermined plane throughout their reciprocating motion between an upper position and a lower position.

2. The apparatus of claim 1 further including a first return mechanism and a second return mechanism, said first return mechanism attached to said first flexible member and said frame, and said second return mechanism attached to said second flexible member and said frame.

3. The apparatus of claim 1 wherein said first and second flexible members are connected to said first and second pedal assemblies such that said first and second flexible members are generally planer with respect to said first and second track members.

4. The apparatus of claim 1 wherein said first pedal assembly and said second pedal assembly each includes a support bracket and wherein said of rollers are rotatably mounted to said support brackets.

5. The apparatus of claim 4 wherein at least one of said plurality of rollers are aligned parallel to a longitudinal axis of the apparatus and at least one of said plurality of rollers are aligned parallel to a lateral axis of the apparatus.

6. The apparatus of claim 5 wherein said first track member and said second track member are generally configured as an I-beam.

7. The apparatus of claim 6 wherein said first track member and said second track member are generally linear in configuration and are secured to said frame in a generally vertical orientation.

8. A simulated stair climbing-type exercise apparatus comprising:

a frame adapted for placement on a horizontal surface;

a first pedal assembly having a first pedal and a second pedal assembly having a second pedal, movable with respect to said frame in a vertical direction;

a resistance mechanism secured to said frame;

a transmission including a pair of one way clutches for directly connecting said first pedal assembly and said second pedal assembly to said resistance mechanism such that said resistance mechanism is effective to apply a resistance force opposing said first pedal assembly movement in the downward portion of said vertical direction and said second pedal assembly movement in the downward portion of said vertical direction;

a first drive belt connecting said first pedal assembly to said one of said pair of one way clutches and a second drive belt connecting said second pedal assembly to said other of said pair of one way clutches;

a first return mechanism and a second return mechanism attached to said frame and said first and second drive belts respectively effective to move said first and second pedal assemblies in the upward portion of said vertical movement; and a first track member and a second track member, said first track member secured to said frame and said second track member secured to said frame, said first pedal assembly operably coupled to said first track member and said second track second pedal assembly operably connected to said second pedal assembly such that said first pedal and said second pedal are maintained generally parallel to a predetermined plane throughout said vertical motion of said first and second pedal assemblies.

9. The apparatus of claim 8 wherein said predetermined plane is parallel to said support surface.

10. The apparatus of claim 8 wherein said first track member and said second track member are substantially linear.

11. The apparatus of claim 10 wherein said first pedal assembly and said second pedal assembly additionally include a support bracket and said rollers are rotatably mounted to said support bracket.

12. The apparatus of claim 8 wherein at least one of said plurality of rollers are aligned parallel to a longitudinal axis of the apparatus and at least one of said plurality of rollers are aligned parallel to a lateral axis of the apparatus.

13. The apparatus of claim 8 wherein said first track member and said second track member are generally arcuate in configuration.

* * * * *